US010192449B2

(12) United States Patent
Suzuki et al.

(10) Patent No.: US 10,192,449 B2
(45) Date of Patent: Jan. 29, 2019

(54) COLLISION RISK CALCULATION METHOD, COLLISION RISK CALCULATION DEVICE, AND COMPUTER-READABLE RECORDING MEDIUM

(71) Applicant: FUJITSU LIMITED, Kawasaki-shi, Kanagawa (JP)

(72) Inventors: Hiroko Suzuki, Kawasaki (JP); Takahiro Saito, Asaka (JP)

(73) Assignee: FUJITSU LIMITED, Kawasaki (JP)

( * ) Notice: Subject to any disclaimer, the term of this patent is extended or adjusted under 35 U.S.C. 154(b) by 0 days.

(21) Appl. No.: 15/416,097

(22) Filed: Jan. 26, 2017

(65) Prior Publication Data

US 2017/0287340 A1 Oct. 5, 2017

(30) Foreign Application Priority Data

Mar. 31, 2016 (JP) ..... 2016-073317

(51) Int. Cl.
*G08G 3/02* (2006.01)

(52) U.S. Cl.
CPC ..... *G08G 3/02* (2013.01)

(58) Field of Classification Search
CPC ..... G08G 3/02; G08G 3/00
See application file for complete search history.

(56) References Cited

U.S. PATENT DOCUMENTS

| | | | | |
|---|---|---|---|---|
| 6,249,241 | B1 * | 6/2001 | Jordan | G01S 7/003 342/41 |
| 7,548,194 | B2 * | 6/2009 | Wood | G01S 13/726 340/984 |
| 9,865,167 | B1 * | 1/2018 | Liang | G08G 1/16 |
| 2006/0290562 | A1 * | 12/2006 | Ehresman | G08G 3/02 342/41 |
| 2007/0188734 | A1 | 8/2007 | Waquet | |
| 2008/0133131 | A1 * | 6/2008 | Poreda | G08G 3/02 701/418 |
| 2011/0210865 | A1 * | 9/2011 | Lee | G08G 3/02 340/903 |

(Continued)

FOREIGN PATENT DOCUMENTS

| | | | |
|---|---|---|---|
| JP | 6-325300 | A | 11/1994 |
| JP | 10-250681 | A | 9/1998 |

(Continued)

OTHER PUBLICATIONS

Yasuda et al., JP2015186956, Oct. 29, 2015 (machine translation).*

*Primary Examiner* — Courtney D Heinle
(74) *Attorney, Agent, or Firm* — Westerman, Hattori, Daniels & Adrian, LLP

(57) ABSTRACT

A non-transitory computer-readable recording medium stores a collision risk calculation program that causes a computer to execute a process including: acquiring traveling information on a position and a speed of each of a first ship and a second ship; calculating a future traveling direction range of one or both of the first ship and the second ship based on a position of each of the first ship and the second ship and traveling information of a ship that sailed in a past; and calculating a risk of collision between the first ship and the second ship based on the future traveling direction range.

10 Claims, 11 Drawing Sheets

(56) References Cited

U.S. PATENT DOCUMENTS

| | | | | |
|---|---|---|---|---|
| 2012/0271538 | A1* | 10/2012 | Lee | G08G 3/02 701/117 |
| 2013/0041523 | A1* | 2/2013 | Jensen | G08G 3/02 701/1 |
| 2014/0180566 | A1* | 6/2014 | Malhotra | G08G 3/02 701/300 |
| 2016/0101838 | A1* | 4/2016 | Kojima | B63B 49/00 701/21 |
| 2017/0043848 | A1* | 2/2017 | Rigdon | G08B 13/00 |

FOREIGN PATENT DOCUMENTS

| | | | |
|---|---|---|---|
| JP | 2004-178258 | A | 6/2004 |
| JP | 2005-31726 | A | 2/2005 |
| JP | 2008-514483 | A | 5/2008 |
| JP | 2015-186956 | A | 10/2015 |
| WO | 2006035305 | A3 | 4/2006 |

* cited by examiner

| GRID ID | GRID RANGE |
|---|---|
| 1 | (xx, xx), (xx, xx), (xx, xx), (xx, xx) |
| 2 | (xx, xx), (xx, xx), (xx, xx), (xx, xx) |
| ⋮ | ⋮ |

| APPROACH ANGLE | FREQUENCY | |
|---|---|---|
| | GRID 1 | GRID 6 |
| 0-30° | 31 | 24 |
| 30-60° | 15 | 24 |
| 60-90° | 5 | 16 |
| 90-120° | 1 | 8 |
| 120-150° | 0 | 3 |
| 150-180° | 0 | 1 |
| 180-210° | 0 | 0 |
| 210-240° | 0 | 0 |
| 240-270° | 0 | 0 |
| 270-300° | 0 | 0 |
| 300-330° | 0 | 0 |
| 330-360° | 0 | 0 |
| TOTAL | 52 | 76 |

COLLISION RISK CALCULATION METHOD, COLLISION RISK CALCULATION DEVICE, AND COMPUTER-READABLE RECORDING MEDIUM

CROSS-REFERENCE TO RELATED APPLICATION

This application is based upon and claims the benefit of priority of the prior Japanese Patent Application No. 2016-073317, filed on Mar. 31, 2016, the entire contents of which are incorporated herein by reference.

FIELD

The embodiments discussed herein are related to a computer-readable recording medium, a collision risk calculation method, and a collision risk calculation device.

BACKGROUND

In general, as a size of a ship is increased, a sudden course change or stop thereof becomes more difficult. Accordingly, a technique of avoiding collision between ships has been proposed. For example, a ship includes means for acquiring information of another ship, such as an Automatic Identification System (AIS) or a radar. Calculation of a risk of collision is executed by using such information of another ship. For example, a method that uses Time-To-Collision (TTC) has been known as a method for calculating a risk of collision between ships. In TTC, expected courses in a case where respective ships maintain speeds and directions thereof at a point of time of expectation are obtained, and a period of time until a point of time when the expected courses intersect with one another is calculated.

Japanese Laid-open Patent Publication No. 2015-186956

Japanese Laid-open Patent Publication No. 06-325300

Japanese Laid-open Patent Publication No. 2005-031726

However, in a case where expected course straight lines of two ships as targets for calculating a risk of collision therebetween do not intersect with one another, it may be impossible to calculate TTC. Accordingly, in a related method for calculating a risk of collision between ships by using TTC, it may be impossible to calculate a risk of collision despite a possibility of the risk of collision. For example, although a certain degree of risk exists even in a case where two opposing ships pass one another, it may be impossible to calculate a risk of collision in a case where expected course straight lines thereof do not intersect with one another.

SUMMARY

According to an aspect of the embodiments, a non-transitory computer-readable recording medium stores a collision risk calculation program that causes a computer to execute a process including: acquiring traveling information on a position and a speed of each of a first ship and a second ship; calculating a future traveling direction range of one or both of the first ship and the second ship based on a position of each of the first ship and the second ship and traveling information of a ship that sailed in a past; and calculating a risk of collision between the first ship and the second ship based on the future traveling direction range.

The object and advantages of the invention will be realized and attained by means of the elements and combinations particularly pointed out in the claims.

It is to be understood that both the foregoing general description and the following detailed description are exemplary and explanatory and are not restrictive of the invention.

DESCRIPTION OF EMBODIMENTS

Preferred embodiments will be explained with reference to accompanying drawings. This invention is not limited by these embodiments. It is possible to combine respective embodiments appropriately as long as process contents thereof are consistent with one another. Hereinafter, a case where the invention is applied to a support system that supports sailing of a ship will be described as an example.

System Configuration

Figure 1:
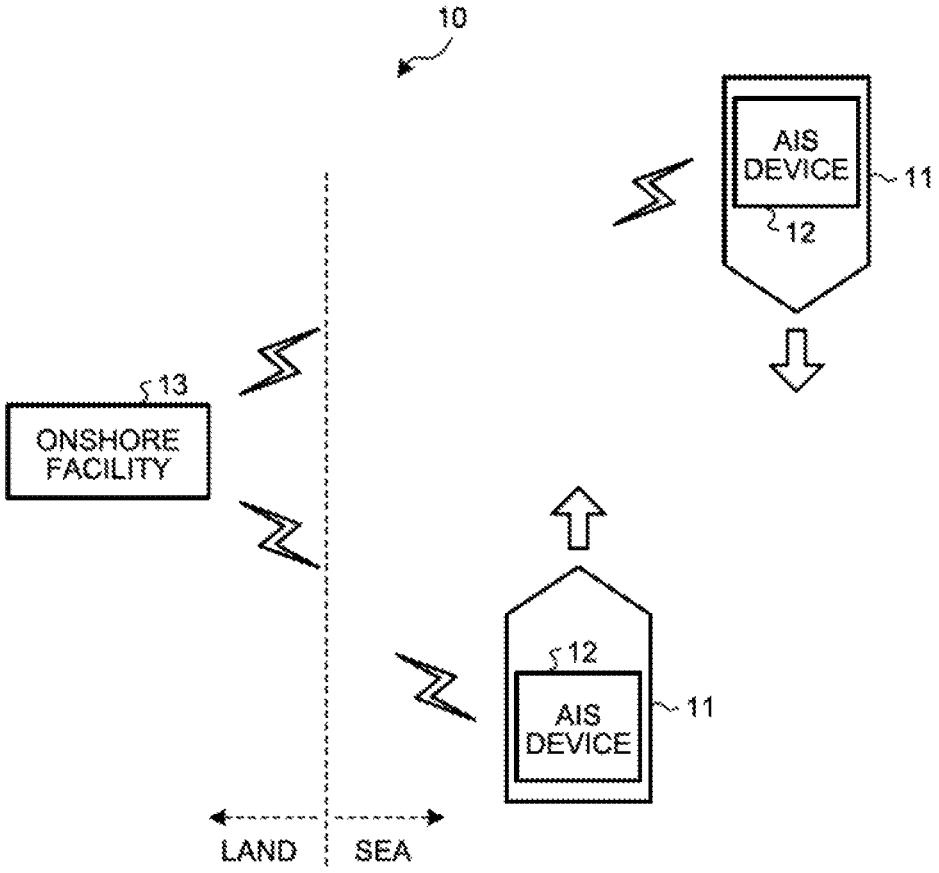
FIG. 1 is a diagram illustrating an example of a general configuration of a support system.

First, an example of a support system 10 according to a first embodiment will be described. FIG. 1 is a diagram illustrating an example of a general configuration of a support system. The support system 10 is a system that supports sailing of a ship.

FIG. 1 illustrates two ships 11 and an onshore facility 13. The ship 11 is mounted with an AIS device 12. For example, a particular ship is obligated to mount the AIS device 12 according to a law or the like. Such a particular ship corresponds to any ship of 300 gross tons or more that engages in an international voyage, any passenger ship that engages in an international voyage, or any ship of 500 gross tons or more that does not engage in an international voyage. The AIS device 12 may also be mounted on a ship other than such a particular ship.

The AIS device 12 periodically transmits AIS information that includes a variety of information on the ship 11 mounted therewith through wireless communication. AIS information includes, for example, information such as a position represented by latitude and longitude, a speed, a ship name, a point of time, a direction of a bow of the ship 11, an identification code of the ship 11 such as a Maritime Mobile Service Identity (MMSI) number, or a length or a width of the ship 11. AIS information is receivable by the other ship 11 or the onshore facility 13. The other ship 11 or the onshore facility 13 can catch a variety of information such as a position of the ship 11, a speed, a ship name, a point of time, a direction of a bow of the ship 11, an identification code of the ship 11, or a length or a width of the ship 11, based on received AIS information.

The onshore facility 13 is, for example, a facility that executes control of sailing of each ship 11, such as a vessel traffic service center or a port traffic control office that has a role in monitoring or providing information for a ship on a sea. The onshore facility 13 catches a position of each ship 11 based on AIS information received from each ship 11, information detected by a radar, or the like, and provides a variety of information on sea traffic to each ship 11.

Configuration of Collision Risk Calculation Device

Figures 2, 3:
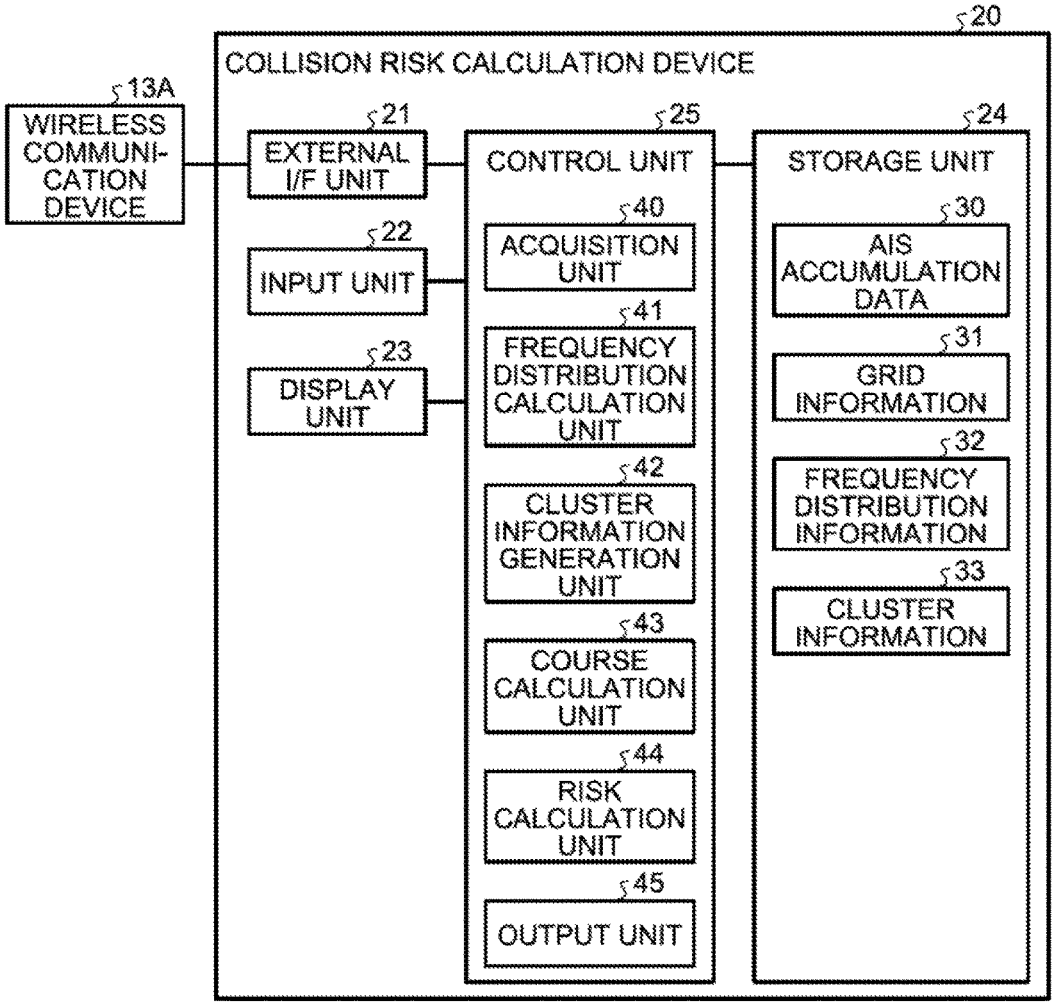
FIG. 2 is a diagram illustrating a general configuration of a collision risk calculation device.
FIG. 3 is a diagram illustrating an example of a data configuration of grid information.

Next, a configuration of a collision risk calculation device 20 according to the first embodiment will be described. FIG. 2 is a diagram illustrating a general configuration of a collision risk calculation device. The collision risk calculation device 20 is a device that is provided for the onshore facility 13 and supports sailing of a ship. For example, the collision risk calculation device 20 is a computer such as a server computer. The collision risk calculation device 20 may be provided as a single computer or may be provided as a plurality of computers. In the present embodiment, a case where the collision risk calculation device 20 is a single computer will be described as an example.

The collision risk calculation device 20 includes an external interface (I/F) unit 21, an input unit 22, a display unit 23, a storage unit 24, and a control unit 25.

The external I/F unit 21 is, for example, an interface that transmits to or receives from another device, a variety of information. The external I/F unit 21 is capable of wireless communication with each ship 11 through a wireless communication device 13A such as an antenna provided for the onshore facility 13, and transmits to or receives from each ship 11, a variety of information. For example, the external I/F unit 21 receives AIS information from each ship 11 through the wireless communication device 13A.

The input unit 22 is an input device that inputs a variety of information. For the input unit 22, an input device is provided that accepts input of an operation, such as a mouse or a keyboard. The input unit 22 accepts input of a variety of information. For example, the input unit 22 accepts input of an operation for instructing starts of a variety of processes. The input unit 22 inputs operation information that indicates a content of an accepted operation to the control unit 25.

The display unit 23 is a display device that displays a variety of information. For the display unit 23, a display device such as a Liquid Crystal Display (LCD) or a Cathode Ray Tube (CRT) is provided. The display unit 23 displays a variety of information. For example, the display unit 23 displays a variety of screens such as an operation screen.

The storage unit 24 is a storage device such as a hard disk, a Solid State Drive (SSD), or an optical disk. The storage unit 24 may be a data rewritable semiconductor memory such as a Random Access Memory (RAM), a flash memory, or a Non-Volatile Static Random Access Memory (NVS-RAM).

The storage unit 24 stores an Operating System (OS) and a variety of programs that are executed by the control unit 25. For example, the storage unit 24 stores a program for executing a data generation process or a collision risk calculation process as described later. The storage unit 24 further stores a variety of data that are used for a program that is executed by the control unit 25. For example, the storage unit 24 stores AIS accumulation data 30, grid information 31, frequency distribution information 32, and cluster information 33.

The AIS accumulation data 30 are data provided by accumulating AIS information received from each ship 11.

The grid information 31 is data including a variety of information on a grid provided by dividing a target range that is a target for control of sailing for the onshore facility 13 into grids with a predetermined size. For example, the grid information 31 includes identification information for identifying a grid and information of a position of a boundary of a region of a grid. A detail of a grid will be described later.

FIG. 3 is a diagram illustrating an example of data configuration of grid information. As illustrated in FIG. 3, the grid information 31 includes items such as a "grid ID" and a "grid range". Each item of the grid information 31 as illustrated in FIG. 3 is an example and another item may be included therein.

An item of grid ID is an area for storing identification information for identifying a grid. A grid is provided with a grid identifier (ID) as identification information for identification thereof. A grid identifier provided to a grid is stored in an item of grid ID. An item of grid range is an area for storing latitude and longitude of a position of each vertex of a grid region.

Herein, a size of a grid will be described. In a case of a ship, avoidance behavior for avoiding collision is executed as turning around for at least approximately 30 seconds or more. For example, a risk of collision as described later is evaluated in 10 seconds such that there is a high possibility of reading a change of the risk. As a general sailing speed of a ship is approximately 10 to 12 knots (kn), a sailing distance for 10 seconds is approximately 50 to 60 m. In the present embodiment, in order to evaluate a risk of collision stably, a size of a grid is determined in such a manner that a ship can be prevented from being positioned in a non-adjacent grid in a case where a position of the ship is obtained on a cycle to evaluate the risk of collision. For example, a grid is a rectangular region with a side length of 100 m at a minimum. A side length of a grid may be 100 to 200 m. A shape of a grid is not limited to a rectangular shape. For example, a polygonal shape such as a triangular shape or a hexagonal shape may be allowed. A target range may be divided into grids as a combination of multiple types of polygonal shapes.

The frequency distribution information 32 is data that include, for each grid, a variety of information on a ship that sailed in a past. For example, the frequency distribution information 32 includes a variety of frequency distributions obtained from sailing of a ship that sailed in a past.

The cluster information 33 is data that include a variety of information on grids with similar frequency distributions. For example, the cluster information 33 includes hierarchical information of clusters provided by hierarchically classifying grids with similar frequency distributions.

The control unit 25 is a device that controls the collision risk calculation device 20. For the control unit 25, an electronic circuit such as a Central Processing Unit (CPU) or a Micro Processing Unit (MPU) or an integrated circuit such as an Application Specific Integrated Circuit (ASIC) or a Field Programmable Gate Array (FPGA) can be employed.

The control unit 25 includes an internal memory for storing a program that defines steps of a variety of processes, and control data, and thereby, executes the variety of processes. The control unit 25 operates a variety of programs, and thereby, functions as a variety of processing units. For example, the control unit 25 includes an acquisition unit 40, a frequency distribution calculation unit 41, a cluster information generation unit 42, a course calculation unit 43, a risk calculation unit 44, and an output unit 45.

The acquisition unit 40 acquires a variety of information. For example, the acquisition unit 40 acquires traveling information on both a position and a speed of each ship. For example, the acquisition unit 40 acquires AIS information from each ship 11 through the wireless communication device 13A as traveling information of each ship. The acquisition unit 40 stores the acquired AIS information as the AIS accumulation data 30. For a speed of each ship, a speed included in AIS information may be used or calculation thereof may be executed from a change of a position of each ship with respect to a point of time. Although a case where AIS information is received by the collision risk calculation device 20 will be described in the present embodiment, the AIS information may be stored in an external storage device such as a "storage" device. In such a case, the acquisition unit 40 acquires AIS information of each ship 11 from an external storage device.

The frequency distribution calculation unit 41 calculates, for each grid, a frequency distribution that indicates a feature of sailing of a ship that has passed through the grid. For example, the frequency distribution calculation unit 41 obtains, for each grid, a traveling direction of each ship that has passed the grid, from the AIS accumulation data 30. For example, the frequency distribution calculation unit 41 obtains, for each grid, a position of each ship that has passed through the grid, at each point of time, with reference to the AIS accumulation data 30, and calculates an approach angle of each ship with respect to such a grid, as a traveling direction thereof. The frequency distribution calculation unit 41 also obtains, for each grid, a speed of each ship that has passed through the grid, with reference to the AIS accumulation data 30. Such a speed may be an average speed when a ship passes through a grid, or may be a speed at a point of time when a ship travels into a grid. In a case where periods of transmission of AIS information from respective ships are different from one another, the frequency distribution calculation unit 41 may obtain a position or a speed of each ship at each point of time from a position or a speed in the AIS information based on interpolation. For example, the frequency distribution calculation unit 41 calculates a position or a speed of each ship at each point of time every 1 second based on interpolation.

The frequency distribution calculation unit 41 calculates a frequency distribution of an approach angle and a frequency distribution of a speed for each grid, from an approach angle and a speed of each ship for each grid. For example, the frequency distribution calculation unit 41 calculates, for each grid, the number of occurrences of an approach angle in each hierarchy that is a hierarchy classified every a predetermined angle (for example, 1°), and calculates a frequency distribution of an approach angle in such a manner that the number of occurrences in each hierarchy is provided as a frequency. The frequency distribution calculation unit 41 also calculates, for each grid, the number of occurrences of a speed in each hierarchy that is a hierarchy classified every a predetermined speed (for example, 1 kn), and calculates a frequency distribution of a speed in such a manner that the number of occurrences in each hierarchy is provided as a frequency. The frequency distribution calculation unit 41 stores, for each grid, a frequency distribution of an approach angle and a frequency distribution of a speed as the frequency distribution information 32.

Figure 4:
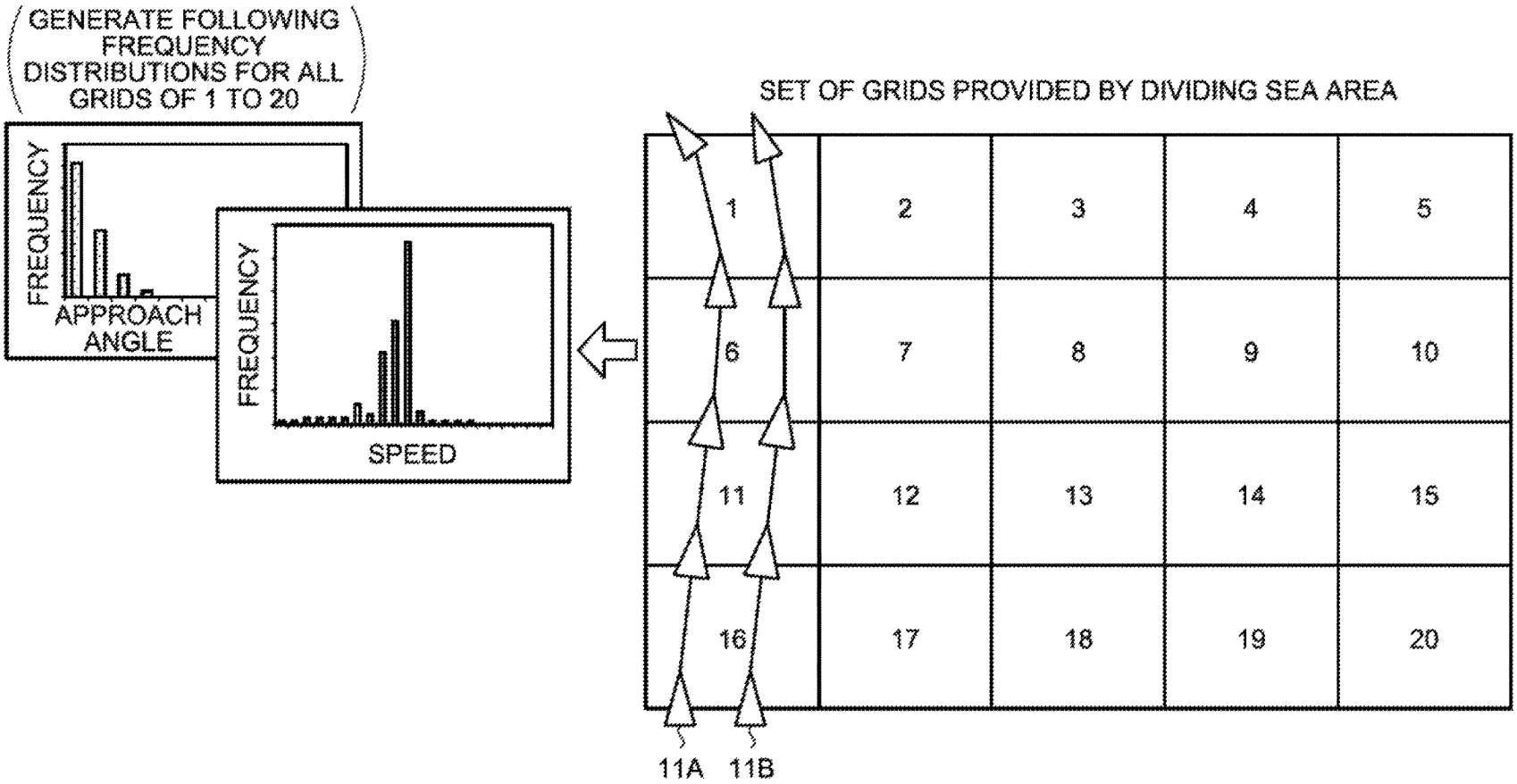
FIG. 4 is a diagram illustrating an example of frequency distributions of an approach angle and a speed for each grid.

FIG. 4 is a diagram illustrating an example of frequency distributions of an approach angle and a speed for each grid. An example of FIG. 4 illustrates grids with grid IDS of 1 to 20 as a set of grids provided by dividing a sea area. FIG. 4 also illustrates simplified ship tracks of ships 11A and 11B that sailed in a past. The frequency distribution calculation unit 41 calculates, for each grid, a frequency distribution of an approach angle and a frequency distribution of a speed.

The cluster information generation unit 42 generates the cluster information 33 for clustering respective grids. For example, the cluster information generation unit 42 calculates a similarity between grids based on frequency distributions included in the frequency distribution information 32. The cluster information generation unit 42 evaluates how similar tendencies of traffic flows in respective grids are to one another. Herein, an object is to evaluate how similar a tendency of a traffic flow is to that in an adjacent grid, and hence, the cluster information generation unit 42 smooths frequency distributions included in the frequency distribution information 32 as follows. For example, the cluster information generation unit 42 aggregates frequencies in a frequency distribution at an interval of a predetermined angle (herein, 1°) that is included in the frequency distribution information 32, at an interval of predetermined hierarchy width (for example, 30°). Herein, the cluster information generation unit 42 aggregates frequencies in a width of hierarchy width/2. For example, frequencies of an approach angle of 15° to 75° are aggregated in a hierarchy of 30° to 60°. That is, the cluster information generation unit 42 overlaps mutual half ranges of adjacent ranges, at an interval of a predetermined range, so that frequencies are aggregated. Thereby, for example, a frequency at 70° is repeatedly aggregated in both of a hierarchy of 30° to 60° and a hierarchy of 60° to 90°. Thus, one frequency is aggregated in two adjacent ranges to execute smoothing, and thereby, a smoothed frequency distribution of an approach angle can indicate a general tendency of the approach angle. The cluster information generation unit 42 aggregates a frequency distribution of a speed that is included in the frequency distribution information 32 similarly to that of an approach angle, so that a smoothed frequency distribution of a speed is calculated. For a grid with the number of ships that traveled in a past being 0, the cluster information generation unit 42 provides an average value for 9 surrounding grids as an aggregated value.

The cluster information generation unit 42 evaluates how similar tendencies of traffic flows in respective grids are to one another, and executes hierarchical clustering for hierarchically classifying grids with similar tendencies of traffic flows. For example, the cluster information generation unit 42 executes hierarchical clustering by using a distance relating to a similarity between clusters that is defined as follows.

A case where clusters are not adjacent to one another (=there is no shared grid side therebetween): Distance=Infinity A case where clusters are adjacent to one another: Distance=1−Similarity between clusters A similarity between clusters is any index of a similarity between frequency distributions of two clusters, and for example, a cosine similarity can be used.

Figure 5:
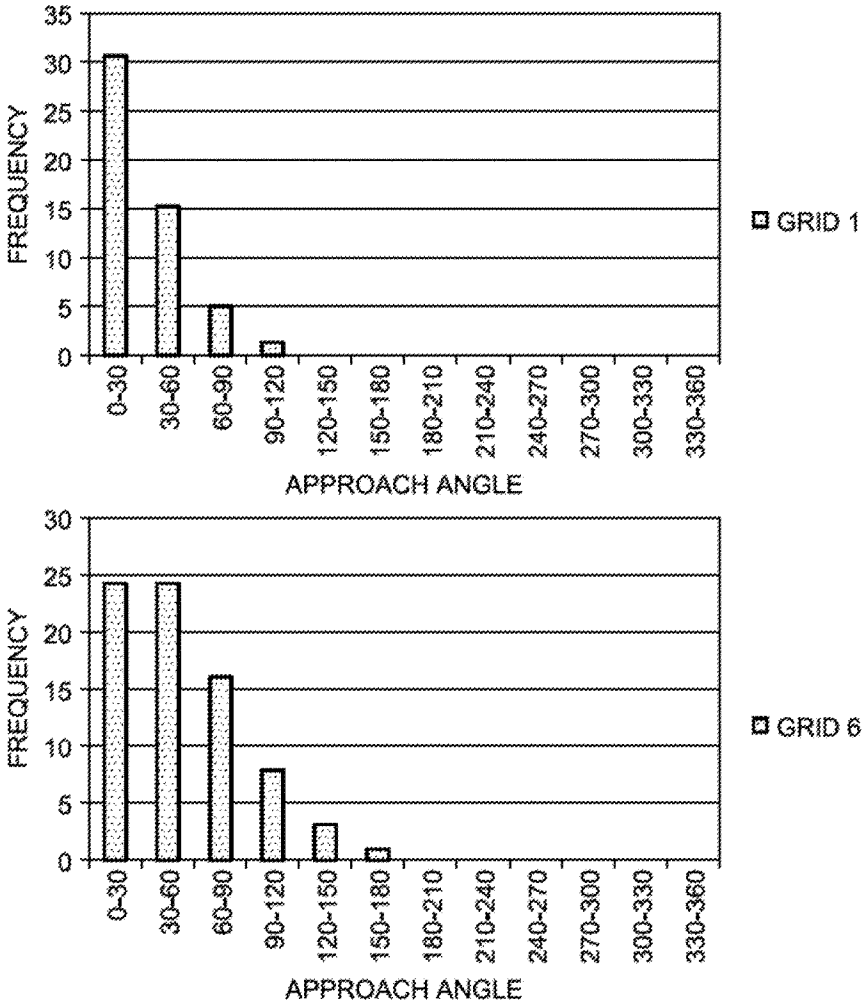
FIG. 5 is a diagram illustrating an example of calculation of a distance relating to a similarity between clusters (grids)

FIG. 5 is a diagram illustrating an example of calculation of a distance relating to a similarity between clusters (grids). An example of FIG. 5 illustrates a frequency distribution provided by smoothing for an approach angle for each of grids with grid IDS of "1" and "6". In a case of an example of FIG. 5, a cosine similarity is calculated as follows.

$$\text{Cosine similarity} = \text{Inner product of two vectors/Product of lengths of respective vectors} = \frac{(31\ 24 + 15\ 25 + 5\ 16 + 1\ 8 + \ldots + 0\ 0)}{(31^2 + 15^2 + 5^2 + 1^2)^{\frac{1}{2}} \times (24^2 + 24^2 + 16^2 + 8^2 + 3^2 + 1^2)^{\frac{1}{2}}} = 0.89$$

As illustrated in FIG. 4, grids with grid IDS of "1" and "6" are adjacent to one another. Hence, in a case where a cosine similarity is used as a similarity between clusters, a distance between grids with grid IDS of "1" and "6" is calculated as follows.

$$\begin{aligned}\text{Distance} &= 1 - \text{Similarity between clusters}\\ &= 1 - \text{Cosine similarity}\\ &= 1 - 0.89 = 0.11\end{aligned}$$

The cluster information generation unit 42 may calculate a distance from only a smoothed frequency distribution of an approach angle, may calculate a distance from only a smoothed frequency distribution of a speed, or may calculate a distance from a smoothed frequency distribution of an approach angle and a smoothed frequency distribution of a speed.

The cluster information generation unit 42 combines frequency distributions of clusters, provided that each grid is provided as a cluster and both clusters with a smallest distance therebetween are provided as clusters in an upper hierarchy. The cluster information generation unit 42 repeats recalculating a distance between clusters in an upper hierarchy with a combined frequency distribution and combining frequency distributions of clusters, provided that both clusters with a smallest distance therebetween are provided as clusters in an upper hierarchy, so that hierarchical clustering is executed until all grids are provided as a single cluster. The cluster information generation unit 42 stores, for each cluster in each hierarchy, a grid ID of a grid included in such a cluster as the cluster information 33.

Figure 6:
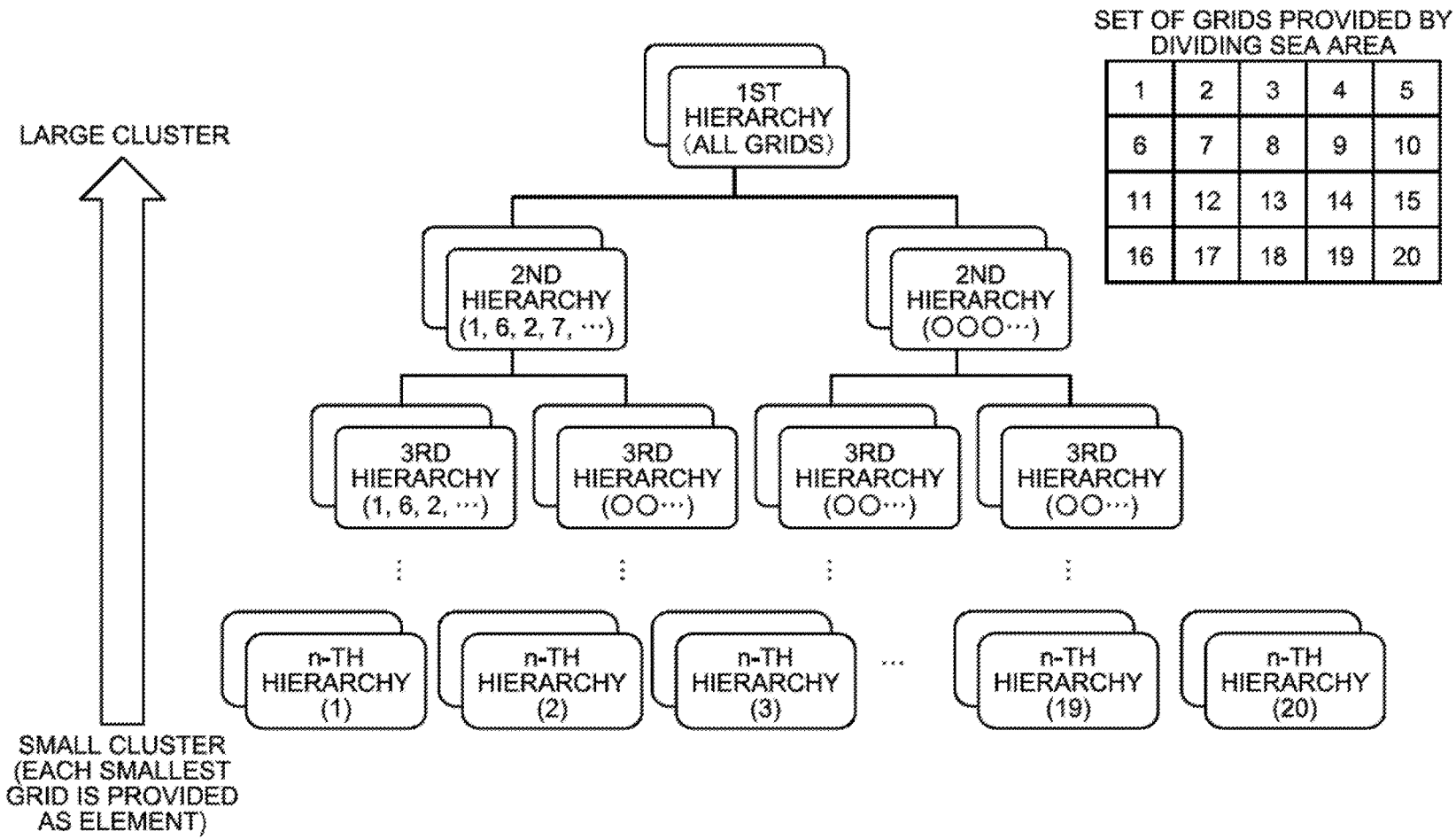
FIG. 6 is a diagram illustrating an example of hierarchical clusters.

FIG. 6 is a diagram illustrating an example of hierarchical clusters. FIG. 6 illustrates respective hierarchical clusters and grid IDS of grids included in the clusters. In an example of FIG. 6, grids with grid IDS of "1" to "20" are provided in respective clusters in an n-th hierarchy, and clusters with a smallest distance are collected in an upper hierarchy. In a top or 1st hierarchy, all grids are provided in a single cluster.

The course calculation unit 43 calculates, for each ship as a target for calculation of a risk of collision, a future traveling direction range with sailing of a ship being expected therein. A ship as a target for calculation of a risk of collision may be specified by a user or may be a ship considered to have a risk of collision. The course calculation unit 43 may provide two ships with a distance between the ships being less than or equal to a predetermined distance, for ships as targets for calculation of a risk of collision. A predetermined distance is, for example, 500 m and is not limited thereto. A predetermined distance may be changeable externally. For example, a screen for setting a predetermined distance may be displayed on the display unit 23, so that the predetermined distance is changeable by input from the input unit 22. A ship as a target for calculation of a risk of collision may be a ship that sailed in a past or may be a ship that is sailing currently. Hereinafter, a case where a risk of collision between ships that are sailing currently is calculated will be described as an example.

For a plurality of ships that are sailing currently and provided with AIS information acquired by the acquisition unit 40, the course calculation unit 43 obtains a distance between ships for each combination of two ships based on positional information in the AIS information. The course calculation unit 43 calculates a future traveling direction range of each of two ships, provided that two ships with a distance therebetween being less than or equal to a predetermined distance are provided for ships as targets for calculation of a risk of collision, respectively. Hereinafter, a case where the course calculation unit 43 calculates a future traveling direction range of one ship will be described as an example. The course calculation unit 43 executes a similar process for each ship to calculate a future traveling direction range thereof.

The course calculation unit 43 calculates a future traveling direction range of a ship as a target for calculation of a risk of collision, based on a frequency distribution of an approach angle for each grid that is included in the frequency distribution information 32. For example, the course calculation unit 43 calculates a future course and a probability of occurrence of the future course, provided that traveling is executed from a position at a point of time when calculation of a future traveling direction range is started, in a direction of an approach angle dependent on a frequency distribution of such an approach angle for a grid that corresponds to a passing position, with a probability dependent on the frequency distribution of such an approach angle. The course calculation unit 43 also calculates a probability of occurrence of each future course according to a speed, based on a frequency distribution of a speed for each grid that is included in the frequency distribution information 32.

For example, the course calculation unit 43 specifies a grid with a ship being positioned therein, based on the grid information 31. The course calculation unit 43 obtains a frequency distribution of an approach angle and a frequency distribution of a speed for the specified grid, from the frequency distribution information 32. The course calculation unit 43 determines a future course for each traveling direction, provided that an approach angle with a frequency being provided in a frequency distribution of such an approach angle is provided as a direction of traveling for a grid. The course calculation unit 43 also calculates, for each traveling direction, a probability of occurrence of a future course in each traveling direction, from a frequency for the traveling direction among all frequencies thereof. The course calculation unit 43 further determines, for each future course, a speed in a grid, provided that a speed with a frequency being provided in a frequency distribution of such a speed for the specified grid is provided as a speed in the grid. The course calculation unit 43 also calculates, for each speed, a probability of occurrence of each speed, from a frequency of the speed among all frequencies thereof. The course calculation unit 43 multiplies, for each future course, a probability of occurrence of the future course by a probability of occurrence of each speed in a grid, so that a probability of occurrence of each future course according to a speed is calculated. The course calculation unit 43 specifies a next passing grid for each future course, provided that a ship sails at each speed in each traveling direction. The course calculation unit 43 executes a similar process for each passing grid to calculate, for each future course and each speed, a future course for each traveling direction in a passing grid and a probability of occurrence of each future course according to a speed. The course calculation unit 43 multiplies a probability of occurrence of each future course and each speed by a probability of occurrence of each future course according to a speed in a passing grid, so that probability of occurrence of each future course and each speed is further calculated. Thus, the course calculation unit 43 repeats, for each grid with a ship passing therethrough, calculation of a probability of occurrence of each future course and each speed, so that a future course and a probability of occurrence of the future course according to a speed are calculated. The course calculation unit 43 may provide an approach angle with a frequency greater than or equal to a predetermined frequency being provided in a frequency distribution of an approach angle as a traveling direction for a grid. The course calculation unit 43 may provide a speed with a frequency greater than or equal to a predetermined frequency being provided in a frequency distribution of a speed as a speed in a grid. The course calculation unit 43 calculates a future course and a probability of occurrence of the future course according to a speed, for each of two ships that are provided for ships as targets for calculation of a risk of collision.

Meanwhile, in a case where the number of data in a frequency distribution is small, it may be impossible to expect a future course accurately. Accordingly, in a case where the number of data in a frequency distribution for a passing grid (a total of all frequencies in the distribution) is less than a predetermined number (for example, 200), the course calculation unit 43 combines frequency distributions for grids with a high similarity until a total of all frequencies in a frequency distribution is a predetermined number. For example, in a case where the number of data in a frequency distribution of an approach angle is less than a predetermined number, the course calculation unit 43 obtains a cluster in a next upper hierarchy with respect to a grid from the cluster information 33 and combines therewith a frequency distribution of an approach angle for another grid that is included in the cluster. The course calculation unit 43 repeats obtaining a cluster in a next upper hierarchy and combining therewith a frequency distribution of an approach angle for another grid that is included in the cluster, until the number of data in a frequency distribution of an approach angle satisfies a predetermined number. The course calculation unit 43 calculates a future course for a passing grid and a probability of occurrence of the future course according to a speed by using a frequency distribution of an approach angle with the number of data that satisfies a predetermined number. The course calculation unit 43 may calculate a future course and a probability of occurrence of the future course according to a speed, provided that all of respective grids with frequency distributions of approach angles being combined are provided as a single grid.

The risk calculation unit 44 calculates a risk of collision between two ships that are provided for ships as targets for calculation of such a risk of collision. For example, the risk calculation unit 44 calculates, for each pattern that is a combination of respective future courses of two ships according to speeds thereof, TTC in a case where the two ships execute sailing according to a pattern. The risk calculation unit 44 also multiplies, for each pattern, probabilities of occurrence of future courses of two ships according to speeds thereof that are provided as the pattern, by one another, so that a probability of occurrence of the pattern is calculated.

The risk calculation unit 44 calculates, for each pattern, a risk of collision by using the calculated TTC. For example, a plurality of indices of a risk of collision that use TTC exists. For a risk of collision that uses TTC, for example, a traffic environment stress value based on an environment stress model (ES model) is provided. A traffic environment stress value (SJs) can be calculated from the following formula (1).

$$SJs=\alpha(\mathrm{TTC}\times Vr/Lm)+\beta \quad (1)$$

Herein,

Vr: Relative approach speed [M/S];

Lm: Average ship length of one's own and other's ships [M];

$\alpha=0.0019\times\mathrm{Lm}$; and $\beta$: Coefficient.

The risk calculation unit 44 multiplies, for each pattern, the calculated risk of collision by a probability of occurrence of the pattern, so that a risk of collision according to a pattern is calculated. The risk calculation unit 44 calculates a final risk of collision provided by summing risks of collision according to patterns. For example, $P_{ij}$ is a probability of occurrence of a pattern for a combination of a speed i and a future course j. Furthermore, $\mathrm{Risk}_{ij}$ is a risk of collision for such a pattern. In such a case, a final risk of collision Risk can be calculated from the following formula (2).

$$\mathrm{Risk}=\Sigma P_{ij}\times\mathrm{Risk}_{ij} \quad (2)$$

Figure 7A:
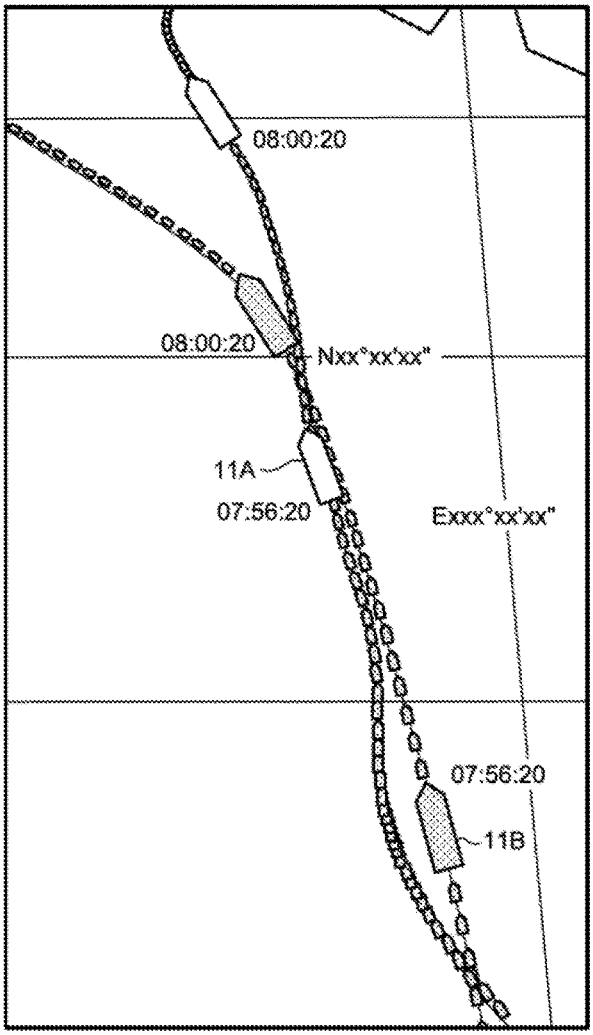
FIG. 7A and FIG. 7B are diagrams illustrating an example of a calculated risk of collision.
Figure 7B:
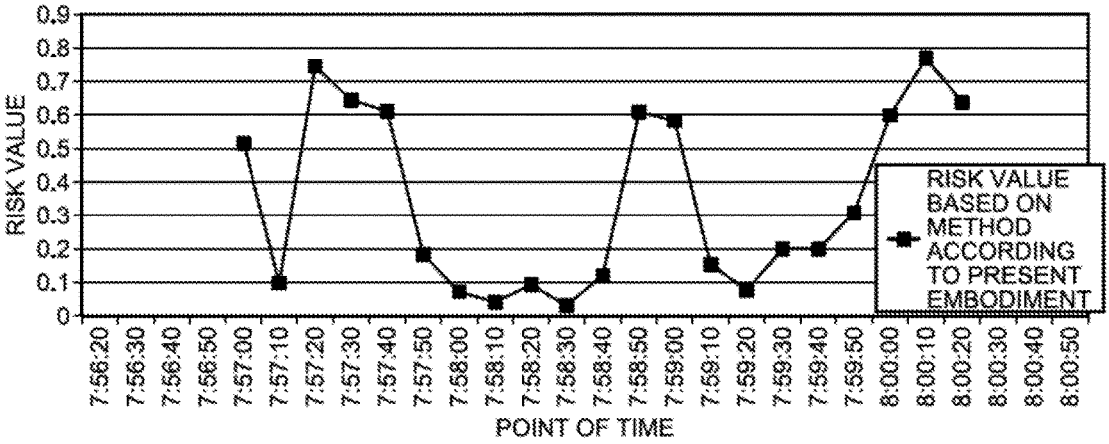

FIGS. 7A and 7B are diagrams illustrating an example of a calculated risk of collision. FIG. 7A illustrates ship tracks of ships 11A and 11B at each point of time. FIG. 7B illustrates a change of a risk of collision between the ships 11A and 11B with respect to a point of time as calculated by a method according to the present embodiment. The ship 11A sails upward. The ship 11B sails upward behind the ship 11A and subsequently changes a course leftward. In an example of FIGS. 7A and 7B, in a case where a distance between the ships 11A and 11B is less than or equal to a predetermined distance, expected course straight lines of the ships 11A and 11B are obtained to calculate TTC and thereby calculate a risk of collision. In an example of FIG. 7A, expected course straight lines of the ships 11A and 11B do not intersect with one another at all points of time when a distance therebetween is less than or equal to a predetermined distance. Accordingly, in a related method, it is impossible to calculate TTC at all points of time and it is impossible to calculate a risk of collision. On the other hand, as illustrated in FIG. 7B, a variety of future courses and probabilities of occurrence of the future courses from sailing of a ship in a past are calculated in a method according to the present embodiment, so that it is possible to calculate TTC and it is possible to calculate a risk of collision.

Figure 8A:
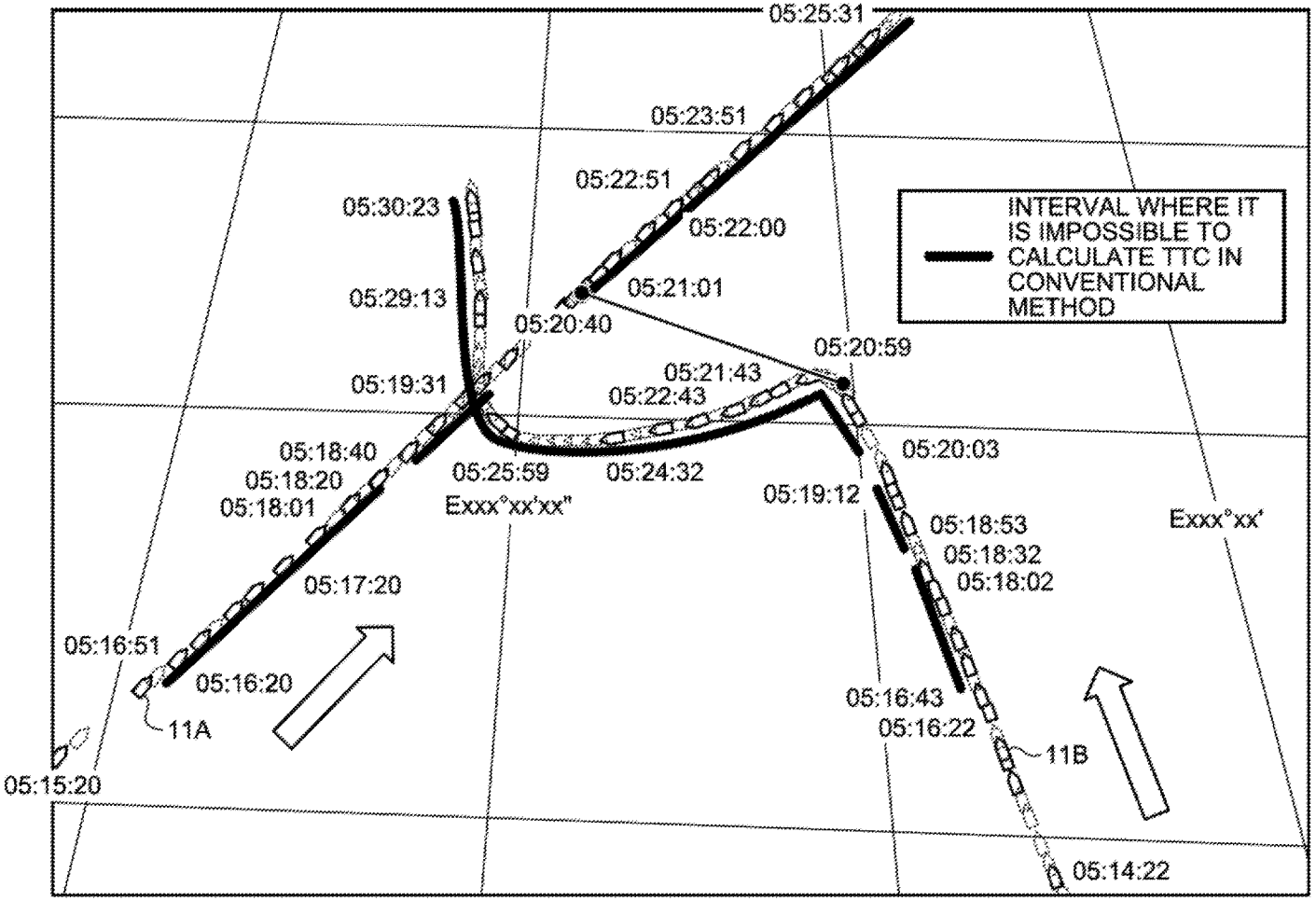
FIG. 8A is a diagram illustrating another example of a calculated risk of collision.

FIG. 8A is a diagram illustrating another example of a calculated risk of collision. FIG. 8A illustrates ship tracks of the ships 11A and 11B at each point of time. The ship 11A sails rightward and linearly. The ship 11B sails upward and changes a course leftward in order to avoid the ship 11A. In an example of FIG. 8A, in a case where a distance between the ships 11A and 11B is less than or equal to a predetermined distance, expected course straight lines of the ships 11A and 11B are obtained to calculate TTC and thereby calculate a risk of collision. An example of FIG. 8A sensitively responds to a directional change of the ship B in spite of a situation where the ships 11A and 11B are approaching one another, and frequently generates an interval where expected course straight lines of the ships 11A and 11B do not intersect with one another and thereby it may be impossible to calculate TTC. On the other hand, in a method according to the present embodiment, a risk of collision can also be calculated in an interval where it is impossible to calculate TTC in a related method.

Figure 8B:
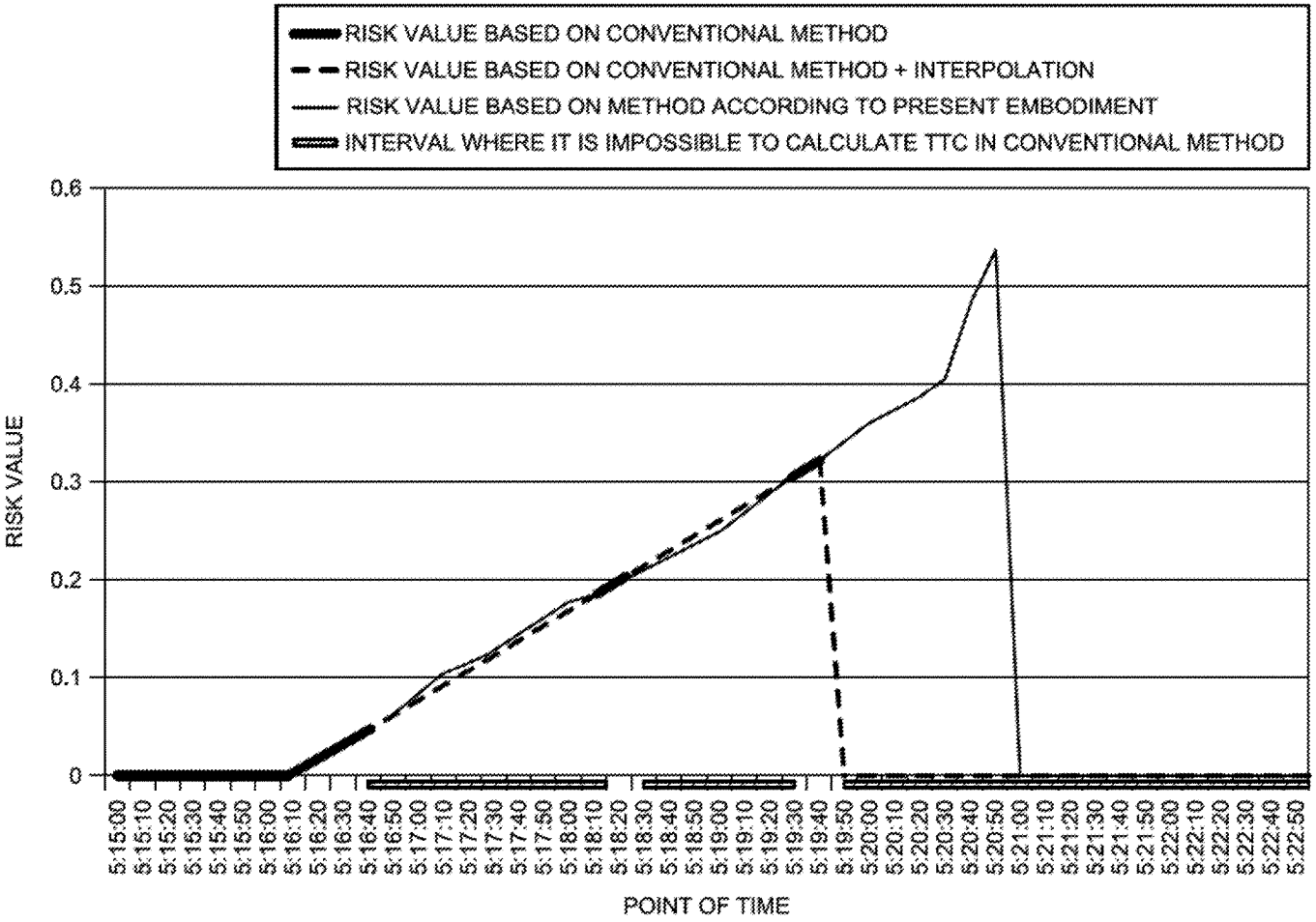
FIG. 8B is a diagram illustrating an example of a calculated risk of collision.

FIG. 8B is a diagram illustrating an example of a calculated risk of collision. FIG. 8B illustrates a change of a risk of collision between the ships 11A and 11B with respect to a point of time as illustrated in FIG. 8A. FIG. 8B illustrates a graph of a change of a risk value based on a related method. In a related method, an interval where it is impossible to calculate TTC is provided, so that a discontinuous graph with a disconnected risk of collision is provided. FIG. 8B illustrates, at a bottom of a graph, an interval where it is impossible to calculate TTC in a related method. Accordingly, it can also be considered that a risk of collision is obtained by, for example, a linear interpolation or the like for a disconnected portion of such a risk of collision. FIG. 8B illustrates a graph of a change of a risk value based on a related method+an interpolation. However, an interval is provided where it may be impossible to obtain a risk of collision even though a linear interpolation or the like is executed. In an example of FIG. 8B, it may be impossible to obtain a risk of collision at or after 5:19:50. On the other hand, FIG. 8B illustrates a graph of a change of a risk value based on a method according to the present embodiment. In a method according to the present embodiment, a risk of collision can also be calculated in an interval where it is impossible to calculate TTC in a related method. At a point of time when a risk of collision between the ships 11A and 11B immediately before avoidance behavior thereof is high, such a risk of collision reaches a peak and avoidance behavior is started to reduce the risk. That is, in a method according to the present embodiment, such a risk of collision corresponds to a practical risk of collision.

The output unit 45 executes a variety of output. For example, the output unit 45 outputs a warning in a case where a risk of collision as calculated by the risk calculation unit 44 is higher than or equal to a threshold. For example, the output unit 45 outputs a high risk of collision to a screen, the AIS device 12 of the ship 11 with such a high risk of collision, and an external device. Thereby, the output unit 45 can inform that a risk of collision is high.

Flow of Process

Figure 9:
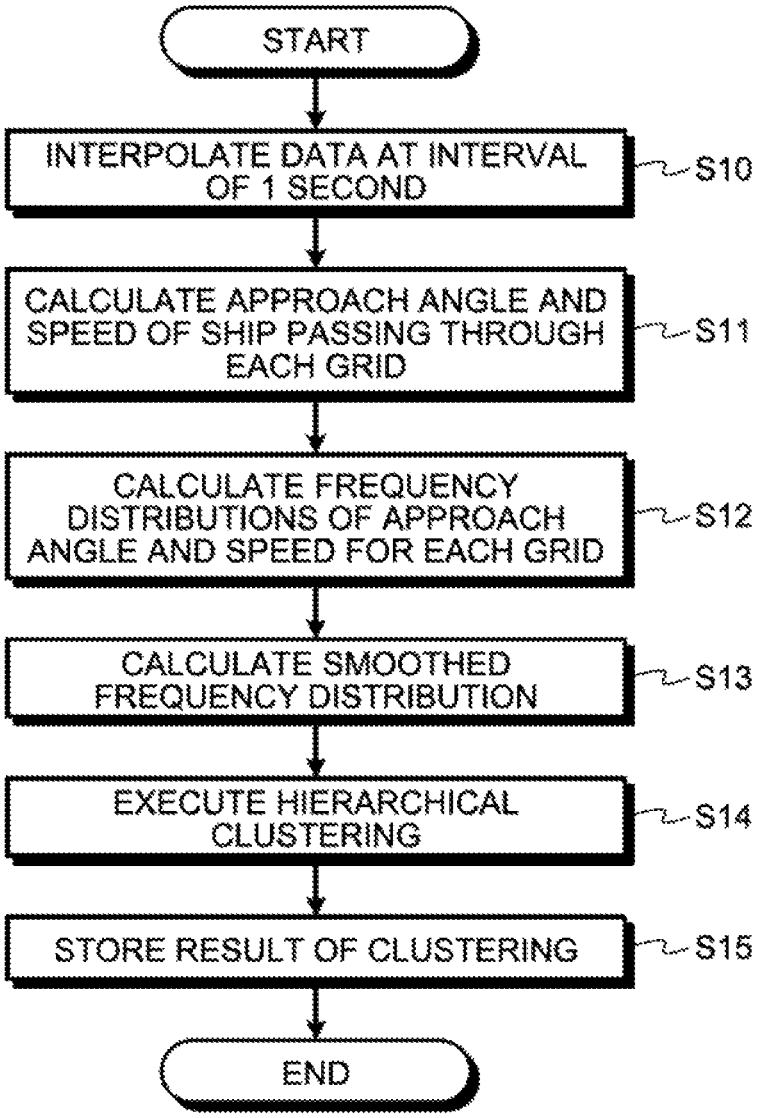
FIG. 9 is a flowchart illustrating an example of steps of a data generation process.

Next, a flow of a data generation process of the collision risk calculation device 20 according to the present embodiment to generate the frequency distribution information 32 and the cluster information 33 will be described. FIG. 9 is a flowchart illustrating an example of steps of a data generation process. Such a data generation process is executed at predetermined timing, for example, timing before a collision risk calculation process as described later or timing when a predetermined operation for instructing a start of the process is accepted.

As illustrated in FIG. 9, the frequency distribution calculation unit 41 calculates a position and a speed of each ship at each point of time every 1 second from the AIS accumulation data 30 by interpolation (S10). The frequency distribution calculation unit 41 calculates, for each grid, an approach angle and a speed of each ship that has passed through the grid (S11). The frequency distribution calculation unit 41 calculates a frequency distribution of an approach angle and a frequency distribution of a speed for each grid from an approach angle and a speed of each ship for each grid and stores the frequency distribution of an approach angle and the frequency distribution of a speed as the frequency distribution information 32 (S12).

The cluster information generation unit 42 calculates a smoothed frequency distribution of a speed for a frequency distribution included in the frequency distribution information 32 (S13). The cluster information generation unit 42 evaluates how similar tendencies of traffic flows in respective grids are to one another, and executes hierarchical clustering for hierarchically classifying grids with similar tendencies of traffic flows (S14). The cluster information generation unit 42 stores, for each cluster in each hierarchy, a grid ID of a grid that is included in such a cluster, as the cluster information 33 (S15) and ends the process.

Figure 10:
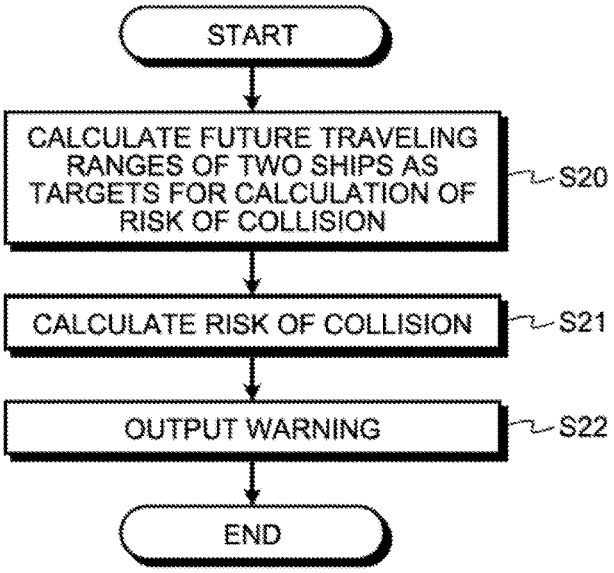
FIG. 10 is a flowchart illustrating an example of steps of a collision risk calculation process.

Next, a flow of a collision risk calculation process of the collision risk calculation device 20 according to the present embodiment to calculate a risk of collision will be described. FIG. 10 is a flowchart illustrating an example of steps of a collision risk calculation process. Such a collision risk calculation process is executed at predetermined timing, for example, timing when two ships as targets for calculation of a risk of collision are specified and a user is specified, or timing when two ships with a distance therebetween being less than or equal to a predetermined distance as targets for calculation of a risk of collision are detected.

The course calculation unit 43 calculates future traveling direction ranges of two ships that are provided as targets for calculation of a risk of collision, based on a frequency distribution of an approach angle for each grid that is included in the frequency distribution information 32 (S20). For example, the course calculation unit 43 calculates a future course and a probability of occurrence of the future course, provided that traveling is executed from a position at a point of time when calculation of a future traveling direction range is started, in a direction of an approach angle dependent on a frequency distribution of such an approach angle for a grid that corresponds to a passing position, with a probability dependent on the frequency distribution of such an approach angle. The course calculation unit 43 also calculates a probability of occurrence of each future course according to a speed, based on a frequency distribution of a speed for each grid that is included in the frequency distribution information 32. In a case where the number of data in a frequency distribution for a passing grid is less than a predetermined number, the course calculation unit 43 combines frequency distributions for grids with a high similarity until a total of all frequencies in the frequency distributions is a predetermined number, and calculates a future course and a probability of occurrence of the future course by using such a combined frequency distribution.

The risk calculation unit 44 calculates a risk of collision between two ships that are provided for ships as targets for calculation of a risk of collision (S21). For example, the risk calculation unit 44 calculates, for each pattern that is a combination of respective future courses of two ships according to speeds thereof, TTC in a case where the two ships executes sailing according to the pattern. The risk calculation unit 44 also multiplies, for each pattern, probabilities of occurrence of future courses of two ships according to speeds thereof that are provided as the pattern, by one another, so that a probability of occurrence of the pattern are calculated. The risk calculation unit 44 multiplies, for each pattern, the calculated risk of collision by a probability of occurrence of the pattern, so that a risk of collision according to the pattern is calculated. Then, the risk calculation unit 44 calculates a final risk of collision provided by summing risks of collision according to patterns.

In a case where the calculated risk of collision is higher than or equal to a threshold, the output unit 45 outputs a warning and ends the process (S22).

Advantageous Effect

The collision risk calculation device 20 according to the present embodiment acquires AIS information on each of a position and a speed of each ship. The collision risk calculation device 20 calculates future traveling direction ranges of two ships that are provided as targets for calculation of a risk of collision, based on traveling information of two ships that are provided as targets for calculation of a risk of collision and a ship that sailed in a past. The collision risk calculation device 20 calculates a risk of collision between two ships that are provided as targets for calculation of a risk of collision, based on such future traveling direction ranges. Thereby, the collision risk calculation device 20 can calculate a risk of collision even in a case where expected course straight lines of two ships do not intersect with one another.

Furthermore, the collision risk calculation device 20 according to the present embodiment calculates future traveling direction ranges of two ships based on frequency distribution of a traveling direction of a ship that sailed in a past for each grid. Thereby, the collision risk calculation device 20 can calculate future traveling direction ranges with sailing of two ships being expected therein, based on sailing of a ship in a past for a grid with such two ships sailing therein.

Furthermore, the collision risk calculation device 20 according to the present embodiment calculates a future course and a probability of occurrence of the future course, provided that traveling is executed from a position of each of two ships, in a traveling direction dependent on a frequency distribution for a grid that corresponds to a passing position, with a probability dependent on a frequency distribution of the traveling direction, based on a frequency distribution of a traveling direction of a ship that sailed in a past for each grid. The collision risk calculation device 20 sums values provided by multiplying a risk of collision for each combination of future courses of two ships by each of probabilities of occurrence of such future courses of two ships, to calculate a risk of collision between such two ships. Thereby, the collision risk calculation device 20 can calculate future courses of two ships and probabilities of occurrence of the future courses, based on a feature of sailing of a ship in a past for a grid with such two ships sailing therein, and can calculate an overall risk of collision provided by taking into consideration a combination of cases where each of two ships sails a future course thereof.

Furthermore, the collision risk calculation device 20 according to the present embodiment calculates, for each grid, a future traveling direction range of each of two ships, based on frequency distribution provided by combining a frequency distribution for the grid with a frequency distribution for a grid with a high similarity of a frequency distribution. Thereby, the collision risk calculation device 20 can increase the number of data in a frequency distribution, and hence, can accurately calculate a future traveling direction range with sailing of two ships being expected therein.

Furthermore, the collision risk calculation device 20 according to the present embodiment combines, for each grid, frequency distributions of traveling directions, until a frequency distribution with a predetermined number of data is obtained. Thereby, the collision risk calculation device 20 can calculate a future traveling direction range from a frequency distribution with the number of data being greater than or equal to a predetermined number of data, and hence, can accurately calculate a future traveling direction range with sailing of a ship being expected therein.

Furthermore, the collision risk calculation device 20 according to the present embodiment calculates, for each grid, a probability of occurrence of each future course according to a speed, based on a frequency distribution of a speed that is generated from AIS information of a ship that sailed on the grid in a past. The collision risk calculation device 20 sums values provided by multiplying a risk of collision for each combination of respective future courses of two ships according to speeds thereof by probabilities of occurrence of the respective future courses of two ships at the speeds, to calculate a risk of collision between such two ships. Thereby, the collision risk calculation device 20 can calculate an overall risk of collision provided by taking into consideration a combination of cases where each of two ships sails a future course thereof at a speed thereof.

Although the embodiment for a disclosed device has been described above, a disclosed technique may be implemented in a variety of different modes as well as the embodiment described above. Hereinafter, other embodiments that are included in the present invention will be described.

For example, although a case where a future traveling direction range of each of two ships as targets for calculation of a risk of collision is calculated has been described as an example in the embodiment described above, a disclosed device is not limited thereto. For example, the collision risk calculation device 20 may calculate a future traveling direction range for only one ship among two ships and calculate a risk of collision provided that the other ship maintains current sailing thereof. A risk of collision may be calculated by the AIS device 12. For example, the AIS device 12 of each ship 11 may calculate a future traveling direction range of another surrounding ship 11 and calculate a risk of collision provided that one's own ship maintains current sailing thereof.

Although a case where a future course of a ship and a probability of occurrence of the future course according to a speed thereof are calculated by using a frequency distribution of an approach angle and a frequency distribution of a speed has been described as an example in the embodiment described above, a disclosed device is not limited thereto. For example, the collision risk calculation device 20 may calculate a future course of a ship and a probability of occurrence of the future course by using a frequency distribution of an approach angle to calculate a risk of collision.

Figure 11:
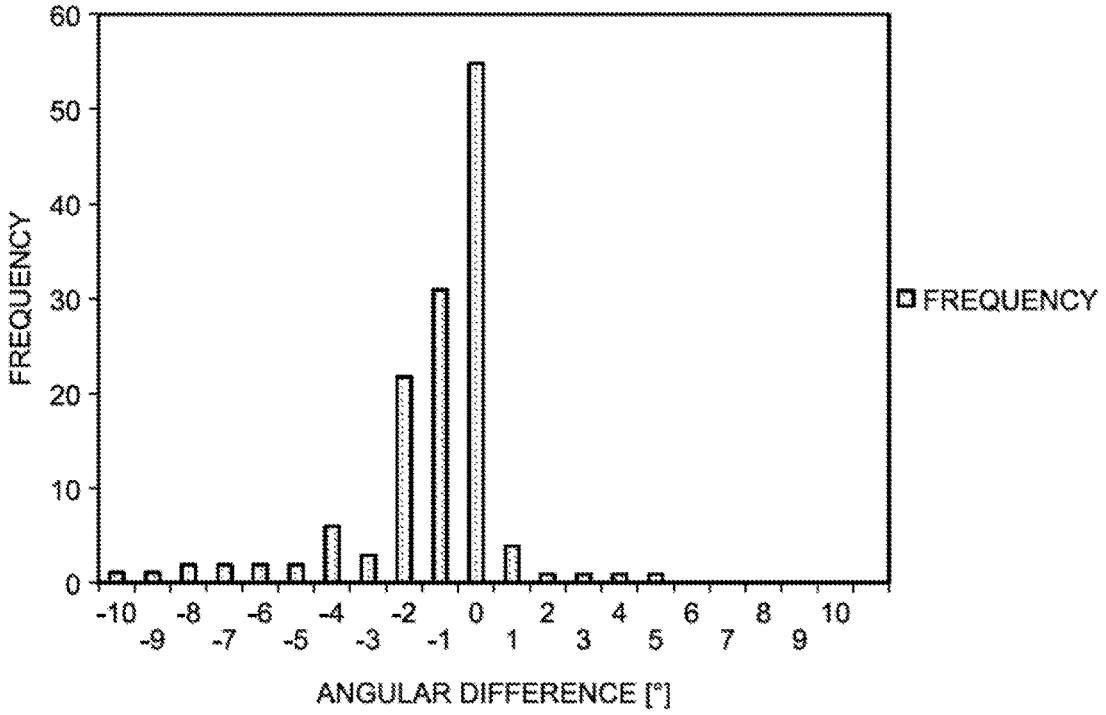
FIG. 11 is a diagram illustrating an example of a frequency distribution of an angular difference between an approach angle and a leaving angle.

Although a case where a frequency distribution of an approach angle for a grid is used as a frequency distribution of a traveling direction for each grid has been described as an example in the embodiment described above, a disclosed device is not limited thereto. For example, the collision risk calculation device 20 may use a frequency distribution of a leaving angle for a grid or a frequency distribution of each angular difference between an approach angle and a leaving angle for a grid, as a frequency distribution of a traveling direction for each grid. FIG. 11 is a diagram illustrating an example of a frequency distribution for each angular difference between an approach angle and a leaving angle. An angular difference between an approach angle and a leaving angle (difference between directions) indicates how a course is changed in a grid. Accordingly, the collision risk calculation device 20 can calculate a future traveling direction range even in a case where a frequency distribution of a difference between an approach angle and a leaving angle is used.

Although a case where AIS information of each ship is acquired as traveling information on a position and a speed of each ship has been described as an example in the embodiment described above, a disclosed device is not limited thereto. For example, the collision risk calculation device 20 may acquire traveling information on a position and a speed of each ship from a position of each ship at each point of time that is detected by radar or the like.

Each component of each device as illustrated in the drawings is functionally conceptual and need not be physically configured as illustrated in the drawings. That is, a specific state of separation or integration of respective devices is not limited to that illustrated in the drawings, and all or a part thereof can be configured to be functionally or physically separated or integrated in an arbitrary unit depending on a variety of loads, usage, or the like. For example, respective processing units that are the acquisition unit 40, the frequency distribution calculation unit 41, the cluster information generation unit 42, the course calculation unit 43, the risk calculation unit 44, and the output unit 45 may be integrated or separated appropriately. All or any part of respective processing functions that are executed in respective processing units can be realized by a CPU and a program that is analyzed and executed in the CPU or realized by hardware based on a wired logic.

Collision Risk Calculation Program

Figure 12:
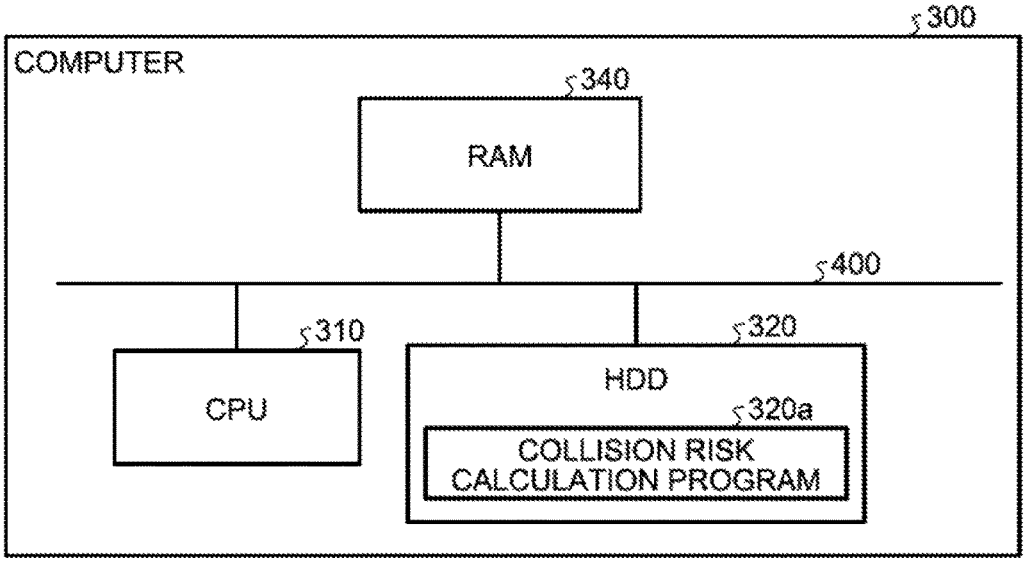
FIG. 12 is a diagram illustrating a computer that executes a collision risk calculation program.

A variety of processes as described in the embodiment as described above can also be realized by executing a preliminarily prepared program in a computer system such as a personal computer or a workstation. Hereinafter, an example of a computer system will be described that executes a program that has a function similar to that of the embodiment as described above. FIG. 12 is a diagram illustrating a computer that executes a collision risk calculation program.

As illustrated in FIG. 12, a computer 300 includes a CPU 310, a Hard Disk Drive (HDD) 320, and a Random Access Memory (RAM) 340. Respective units 310 to 340 are connected to one another through a bus 400.

A collision risk calculation program 320*a* that fulfills a function similar to that of each processing unit in the embodiment as described above is preliminarily stored in the HDD 320. For example, the collision risk calculation program 320*a* is stored that fulfills functions similar to those of the acquisition unit 40, the frequency distribution calculation unit 41, the cluster information generation unit 42, the course calculation unit 43, the risk calculation unit 44, and the output unit 45 in the embodiment as described above. The collision risk calculation program 320*a* may be divided appropriately.

The HDD 320 stores a variety of data. For example, the HDD 320 stores an OS and a variety of data.

The CPU 310 reads from the HDD 320 and execute the collision risk calculation program 320*a*, and thereby executes an operation similar to that of each processing unit in the embodiment. That is, the collision risk calculation program 320*a* executes operations similar to those of the acquisition unit 40, the frequency distribution calculation unit 41, the cluster information generation unit 42, the course calculation unit 43, the risk calculation unit 44, and the output unit 45 in the embodiment.

The collision risk calculation program 320*a* as described above need not be stored in the HDD 320 from a start. For example, a program is stored in a "portable physical medium" that is inserted into the computer 300, such as a flexible disk (FD), a Compact Disk Read Only Memory (CD-ROM), a Digital Versatile Disk (DVD), a magneto optical disk, or an IC card. The computer 300 may read therefrom and execute a program.

A program is stored in "another computer (or server)" or the like that is connected to the computer 300 through a public line, the internet, a LAN, a WAN, or the like. The computer 300 may read therefrom and execute a program.

According to an embodiment of the present invention, an advantageous effect is provided such that a risk of collision can be calculated.

All examples and conditional language recited herein are intended for pedagogical purposes of aiding the reader in understanding the invention and the concepts contributed by the inventors to further the art, and are not to be construed as limitations to such specifically recited examples and conditions, nor does the organization of such examples in the specification relate to a showing of the superiority and inferiority of the invention. Although the embodiments of the present invention have been described in detail, it should be understood that the various changes, substitutions, and alterations could be made hereto without departing from the spirit and scope of the invention.

What is claimed is:

1. A non-transitory computer-readable recording medium storing a collision risk calculation program that causes a computer to execute a process comprising:

acquiring traveling information on a position and a speed of each of a first ship and a second ship;

calculating a future traveling direction range of at least one of the first ship and the second ship based on a position of the at least one of the first ship and the second ship and traveling information of a ship that sailed in a past;

calculating a risk of collision between the first ship and the second ship based on the future traveling direction range by calculating a risk of collision for each combination of cases where each of the first ship and the second ship sails a future course thereof; and outputting information regarding ship-to-ship collision using the risk of collision.

2. The non-transitory computer-readable recording medium according to claim 1, wherein the calculating a future traveling direction range includes calculating, for each region set on a target sea area, a future traveling direction range of one or both of the first ship and the second ship based on frequency distribution information of a traveling direction calculated from traveling information of a ship that sailed on the region in a past.

3. The non-transitory computer-readable recording medium according to claim 2, wherein:

the calculating a future traveling direction range includes calculating a future course and a probability of occurrence of the future course based on the frequency distribution information, provided that traveling is executed from a position of each of the first ship and the second ship, in a direction of an approach angle dependent on a frequency distribution of the approach angle for a grid that corresponds to a position where each of the first ship and the second ship passes, with a probability dependent on a frequency distribution of the traveling direction; and the calculating a risk of collision includes summing values provided by multiplying a risk of collision for a combination of each future course of the first ship and each future course of the second ship by each of a probability of occurrence of a future course of the first ship and a probability of occurrence of a future course of the second ship to calculate a risk of collision between the first ship and the second ship.

4. The non-transitory computer-readable recording medium according to claim 2, wherein the calculating a future traveling direction range includes calculating, for each region, a future traveling direction range of each of the first ship and the second ship based on frequency distribution information provided.

5. The non-transitory computer-readable recording medium according to claim 4, wherein the calculating a future traveling direction range includes combining, for each region, frequency distribution information until frequency distribution information of a traveling direction with a predetermined number of data is obtained.

6. The non-transitory computer-readable recording medium according to claim 3, wherein:

the calculating a future traveling direction range includes calculating, for each region, a probability of occurrence of each future course according to a speed based on frequency distribution information of a speed generated from traveling information of a ship that sailed on the region in a past; and the calculating a risk of collision includes summing values provided by multiplying a risk of collision for each combination of each future course of the first ship according to a speed of the first ship and each future course of the second ship according to a speed of the second ship by each of a probability of occurrence of the future course of the first ship at the speed of the first ship and a probability of occurrence of the future course of the second ship at the speed of the second ship to calculate a risk of collision between the first ship and the second ship.

7. The non-transitory computer-readable recording medium according to claim 1, wherein:

the calculating a future traveling direction range includes calculating, for the first ship, a future traveling direction range based on traveling information of the ship that sailed in a past and calculating, for the second ship, a future course provided that a course is maintained; and the calculating a risk of collision includes calculating a risk of collision between the first ship and the second ship based on a future traveling direction range of the first ship and a future course of the second ship.

8. The non-transitory computer-readable recording medium according to claim 1, wherein the information is a warning.

9. A collision risk calculation method comprising:

acquiring traveling information on a position and a speed of each of a first ship and a second ship, by a processor;

calculating a future traveling direction range of at least one of the first ship and the second ship based on a position of the at least one of the first ship and the second ship and traveling information of a ship that sailed in a past, by the processor;

calculating a risk of collision between the first ship and the second ship based on the future traveling direction range by calculating a risk of collision for each combination of cases where each of the first ship and the second ship sails a future course thereof, by the processor; and outputting information regarding ship-to-ship collision using the risk of collision.

10. A collision risk calculation device comprising:

a processor configured to:

acquire traveling information on a position and a speed of each of a first ship and a second ship;

calculate a future traveling direction range of at least one of the first ship and the second ship based on a position of the at least one of the first ship and the second ship and traveling information of a ship that sailed in a past;

calculating a risk of collision between the first ship and the second ship based on the future traveling direction range by calculating a risk of collision for each combination of cases where each of the first ship and the second ship sails a future course thereof; and outputting information regarding ship-to-ship collision using the risk of collision.

* * * * *